US005430802A

United States Patent [19]

Page

[11] Patent Number: 5,430,802

[45] Date of Patent: Jul. 4, 1995

[54] AUDIO SPEAKER SYSTEM

[76] Inventor: Steven L. Page, 9026 Maple Glen, Dallas, Tex. 75231

[21] Appl. No.: 903,713

[22] Filed: Jun. 24, 1992

[51] Int. Cl.[6] ..... H04R 3/00
[52] U.S. Cl. ..... 381/96; 381/59
[58] Field of Search ..... 381/96, 59, 172; 356/4

[56] References Cited

U.S. PATENT DOCUMENTS

| | | |
|---|---|---|
| 4,327,250 | 4/1982 | von Recklinghausen et al. . |
| 4,610,024 | 9/1986 | Schulhof . |
| 4,739,513 | 4/1988 | Kunugi et al. . |
| 4,752,960 | 6/1988 | Scholz . |
| 4,823,391 | 4/1989 | Schwartz . |
| 4,852,176 | 7/1989 | Truhe . |

FOREIGN PATENT DOCUMENTS

| | | | |
|---|---|---|---|
| 2538073 | 3/1977 | Germany | 381/96 |
| 0228500 | 12/1984 | Japan | 381/96 |
| 0003298 | 1/1985 | Japan | 381/96 |
| 0260395 | 10/1988 | Japan | 381/172 |

OTHER PUBLICATIONS

Dorf, Richard C., *Modern Control Systems,* Jan. 1992, pp. 573–576.

*Primary Examiner*—Forester W. Isen
*Attorney, Agent, or Firm*—Felsman, Bradley, Gunter & Dillon

[57] ABSTRACT

A speaker system includes a controller for driving a loudspeaker. The controller includes a sensor for detecting the present physical position of the speaker. The controller receives this position data as input, along with an audio signal to be reproduced. Using the audio signal as position data, the controller compares it with the actual sensed position data and generates an error signal. An error amplifier uses this error signal to drive the speaker, so that the speaker cone position matches the audio position defined in the audio data. In this manner, the speaker is driven by the error signal rather than the audio signal. In a preferred embodiment, the audio signal and position data are provided as digital signals, and the controller calculates the error signal in a digital signal processor.

15 Claims, 3 Drawing Sheets

AUDIO SPEAKER SYSTEM

BACKGROUND OF THE INVENTION

1. Technical Field

The present invention relates generally to audio systems, and more specifically a closed loop controller for an audio speaker.

2. Description of the Related Art

Numerous improvements have been made over the years in audio reproduction systems to improve performance and audio quality. Amplifier and loudspeaker designs have improved dramatically to provide better response and lower distortion of the audio signal. Significant research continues in these and other areas to improve overall audio system performance.

In recent years, digital storage of audio programs has become increasingly popular. Digital audio disks (usually referred to as CDs) have become well established in the marketplace. Digital audio tape (DAT) is gaining increasing marketplace acceptance. Digital audio storage has a number of advantages over traditional analog storage methods. With the use of error correcting codes, digital storage of audio programs and their subsequent retrieval is substantially distortion free. In addition, some media, such as CDs, do not suffer wear with use as do traditional analog media such as LP records.

However, the use of digital storage media does not solve the problem of signal distortion during playback. The digital signal must be converted to an analog signal for amplification. Additionally, signal conditioning techniques such as frequency band equalization are often performed on the converted analog signal. As is well known in the art, various types of distortion of the original signal are introduced by these components.

It is also well known in the art that speaker systems are generally the portion of the overall system which is the most difficult to manufacture so as to provide distortion-free signal reproduction. This is because loudspeaker systems are electro-mechanical systems, and the mechanical portion of the system has numerous modes which can introduce distortion into the reproduced audio signal. These include flexure of various loudspeaker parts, and mechanical resonances which cause the reproductive efficiency of the speaker to vary with frequency. Expensive speaker systems can be built which help minimize these and other distortions, but the complexity and cost of such systems prohibits their widespread use.

Various prior art systems have been designed in an attempt to compensate for speaker and other distortion added to the audio signal. For example, attempts have been made to monitor the reproduced audio signal at the speaker or in the listening area, with the gain of the amplifier at various frequencies being changed dynamically. Examples of this approach can be found in U.S. Pat. No. 4,327,250, DYNAMIC SPEAKER EQUALIZER, issued to von Recklinghausen, and U.S. Pat. No. 4,610,024, AUDIO APPARATUS, issued to Schulhof.

Another approach is to carefully determine the characteristics of each speaker after manufacture, and store this information in a read only memory. Using this data, a signal can be added to the audio signal in a microcomputer to pre-distort the audio signal. This predistortion theoretically cancels the effects of the speaker. An example of such an approach is shown in U.S. Pat. No. 4,852,176, CONTINUOUS DIFFERENTIAL SIGNAL EQUALIZER, issued to Truhe, Jr.

One drawback of approaches such as those described above is that they are relatively complex and expensive. Although use of such techniques can improve the performance of the audio system, there remains room for improvement.

It would therefore be desirable to provide a controller for an audio speaker which provides a more accurate reproduction of an original audio signal. It would further be desirable for such a controller to utilize digital input signals directly, so that distortion caused by analog components is eliminated.

SUMMARY OF THE INVENTION

Therefore, in accordance with the present invention, a speaker system includes a controller for driving a loudspeaker. The controller includes a sensor for detecting the present physical position of the speaker. The controller receives this position data as input, along with an audio signal to be reproduced. Using the audio signal as position data, the controller compares it with the actual sensed position data and generates an error signal. An error amplifier uses this error signal to drive the speaker, so that the speaker cone position matches the audio position defined in the audio data. In this manner, the speaker is driven by the error signal rather than the audio signal. In a preferred embodiment, the audio signal and position data are provided as digital signals, and the controller calculates the error signal in a digital signal processor.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
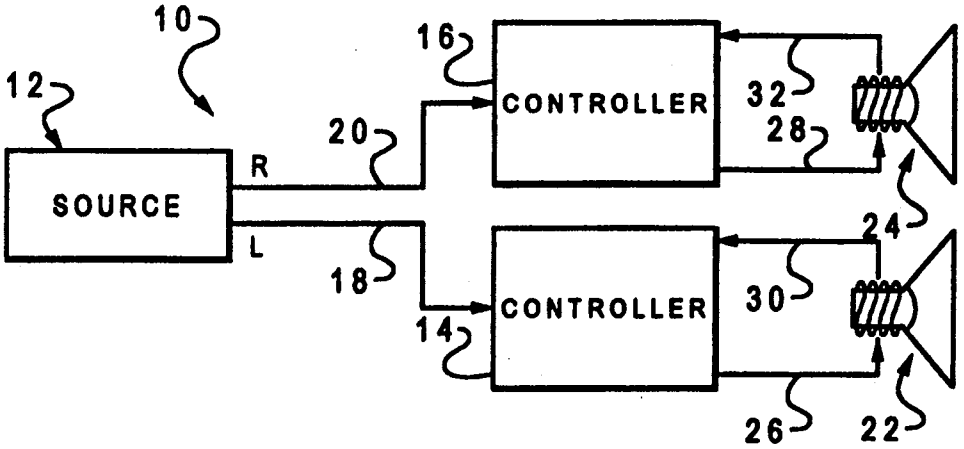
FIG. 1 is a high level block diagram of an audio system according to the present invention.

Referring to FIG. 1, an audio system, designated generally with the reference number 10, includes an audio source 12. Left and right output channels are connected to left and right controllers 14, 16 through left and right signal lines 18, 20, respectively.

Each controller 14, 16 drives the corresponding loudspeaker 22, 24 through a signal line 26, 28. A feedback signal line 30, 32, connects from each speaker to the corresponding controller 14, 16. The feedback signal lines 30, 32 are used to transmit information indicating the physical position of the speakers 22, 24 for use by the corresponding controller 14, 16 as will be described below.

FIG. 1 illustrates two channels being driven by the audio source 12. This is suitable for reproduction of conventional stereo audio programs. To reproduce additional channels, it is necessary simply to provide another controller and speaker combination. For each speaker used, there is an associated controller.

Figure 2:
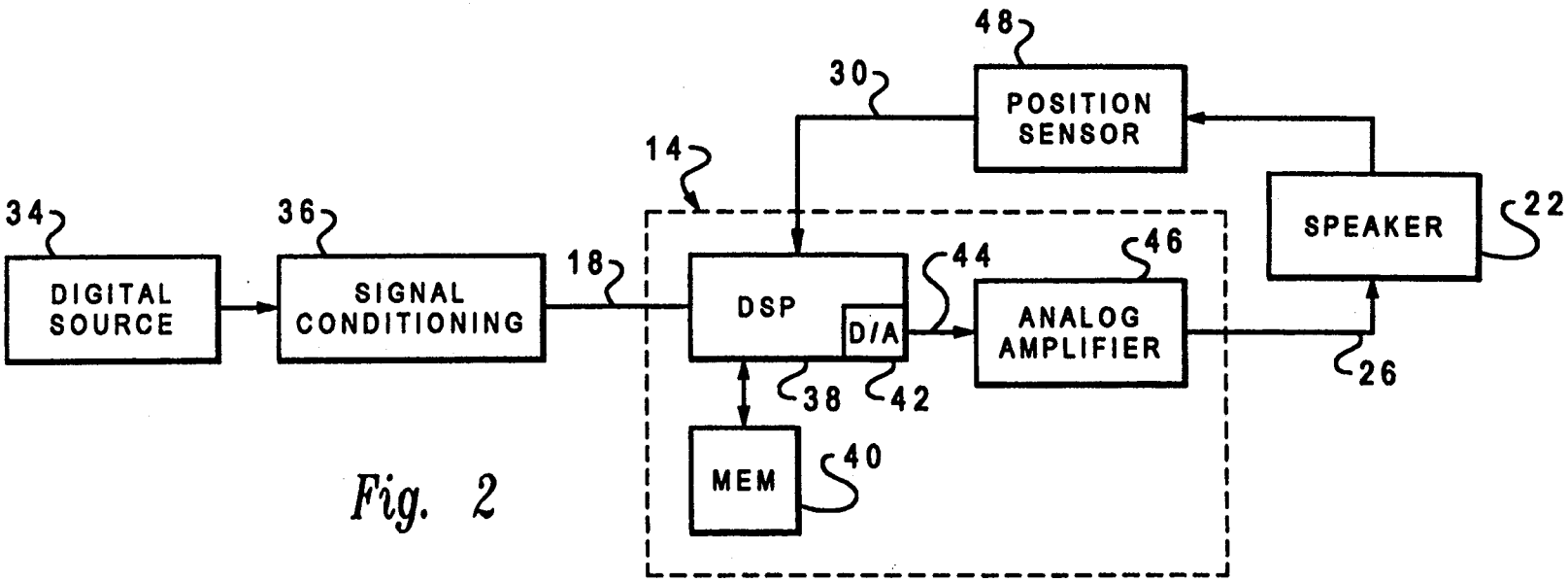
FIG. 2 is a block diagram of an audio controller according to the present invention.

Referring to FIG. 2, a more detailed diagram illustrates a preferred embodiment for a single controller 14 for a single channel. A digital source 34 provides an audio signal to a signal conditioning subsystem 36. The source 34 can be, for example, a compact disk or digital audio tape player. Signal conditioning subsystem 36 is preferably all digital, and can provide frequency band equalization and other special effects as known in the art. A digital audio signal is generated on line 18, and connected to the controller 14.

Within controller 14, a digital signal processor (DSP) 38 accepts the digital audio signal on line 18 as input. DSP 38 has an associated memory 40, and includes a digital/analog converter 42 to generate an analog signal on line 44. DSP 38 can be any appropriate digital signal processor as known in the art, such as the TMS 320 series digital signal processors available from Texas Instruments.

The analog signal on line 44 is amplified in analog amplifier 46, and output on signal line 26 to the speaker 22. Position sensor 48 detects the present position of the movable part of the speaker 22, and generates a corresponding digital position signal which is connected to the DSP 38 on signal line 30. In accordance with the preferred embodiment, the position sensor 48 is of a type which generates a digital position signal directly without performing analog/digital conversion.

The DSP 38, analog amplifier 46, speaker 22, and position sensor 48 form a feedback control loop which can be used to accurately position the moveable portion of the speaker 22 in accordance with the audio signal present on line 18. Since the actual position of the speaker 22 is detected, it is not necessary for analog amplifier 46 to be linear. The signal placed on line 44 by the DSP 38 is an error signal which is proportional to the difference between the desired speaker position, as defined by the signal on line 18, and the actual speaker position as present on signal line 30. Therefore, since amplifier 46 is not actually reproducing an analog audio signal in the traditional sense, nonlinearities in amplifier 46 will be automatically corrected through the action of the feedback loop.

Figure 3:
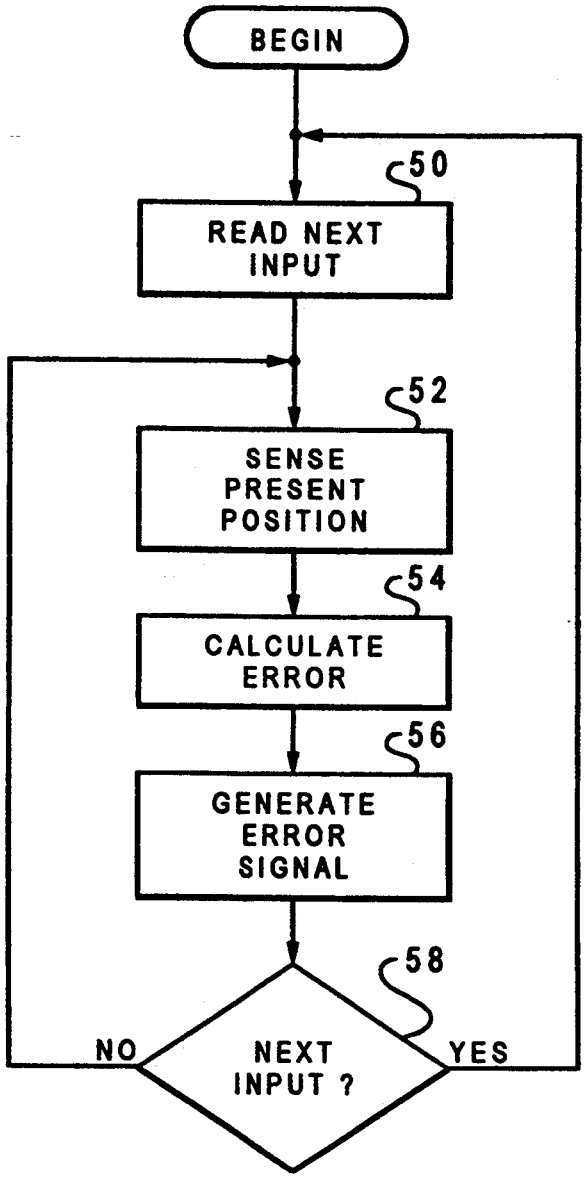
FIG. 3 is a high level flow chart illustrating a control loop of a digital signal processor.

FIG. 3 is a flow chart illustrating operation of the DSP 38 in a preferred embodiment. Once the system begins operation, the DSP reads the next input signal 50 on line 18 and senses the present position of the speaker 52 as indicated by the signal on line 30. An error value is calculated 54, and an error signal generated 56 by the D/A converter 42. A check is made 58 to see if the next input value is available on line 18, and if not, control returns to step 52. If it is available, control returns to step 50.

Decision block 58 indicates that the DSP 38 may perform its error calculations several times during the interval between each signal value becoming available on line 18. This allows for more accurate control of the speaker, but increases cost by requiring a faster processor 38. If a slower DSP 38 is used, only a single error value may be calculated (step 54) for each input presented on line 18. In this event, decision block 58 would not be necessary.

The digital signal presented on line 18 can be encoded in any manner suitable for communication of digital audio data. Preferably, the controller 14 is located in the same physical housing as the speaker 22, with signal line 18 being used to connect it to the remainder of the audio system. Signal line 18 can be either a serial or parallel line, but will generally be a serial signal line due to the typical required separation between the speaker enclosure and the remainder of the audio system. In the preferred embodiment, signal line 18 is an optical fiber, capable of communicating the digitized audio data at a high rate.

The data itself can be encoded in any suitable manner. For example, encoding schemes currently used for compact disks and digital audio tape may be used for the audio data. Since the DSP 38 is, in general, reprogrammable by changing the control program stored in memory 40, the precise data encoding scheme is not important, with practically any reasonable encoding scheme being capable of use by the controller 14.

As known in the art, in order to ensure accurate audio reproduction, the sampling rate of the digital signal, made available from a source 34, should be at least twice the highest frequency to be reproduced by the system. Using currently available standard techniques, such as those used for compact disks, this sampling rate is easily achieved.

A number of different error calculation techniques (step 54) may be performed by the DSP 38, with no particular technique being required by the preferred embodiment of the invention. In a very simple version, a signal proportional to the difference between the incoming audio signal and the present position signal can be generated by the converter 42. In order to properly accommodate highly dynamic passages, it is preferable for the DSP 38 to store several consecutive samples of the audio data, and look ahead for a small period of time in order to generate the error signal. For example, if the audio signal makes a large swing in one direction several samples after the current sample, the DSP could begin moving the speaker slightly ahead of time in order to overcome the mechanical inertia of the coil and cone. This allows the signal processor 38 to compensate for mechanical characteristics of the speaker. If desired, selected parameters of the speaker indicative of its response times at selected frequencies may be stored in the memory 40 for use by the DSP 38 during operation.

If the DSP 38 is powerful enough, it is possible to use more complex signal processing techniques in order to generate the error signal 44. Various linear predictive coding (LPC) techniques are well known in the speech industry and can be used to predict the future position of the speaker. These techniques are especially useful when the DSP 38 operates fast enough to allow several cycles through the smaller loop as shown in FIG. 3. This allows the analog signal on line 44 to be changed in a stepwise fashion several times between consecutive audio data inputs. This minimizes the occurrence of sudden large value changes on signal line 44, both reducing the performance requirements of the analog amplifier 46, and producing smoother motion of the speaker.

As described above, position sensor 48 preferably generates the digital position signals directly, without performing an analog/digital conversion. Several techniques which can be used to implement such a sensor 48 are illustrated in FIGS. 4–7. In general, this technique involves the use of a narrow laser beam which is reflected onto a charge-couple device (CCD) sensor or other optical sensor. A reflective surface is attached to some portion of the speaker which moves, and the position of the speaker can be indicated by light reflected from such surface onto the CCD.

Figure 4:
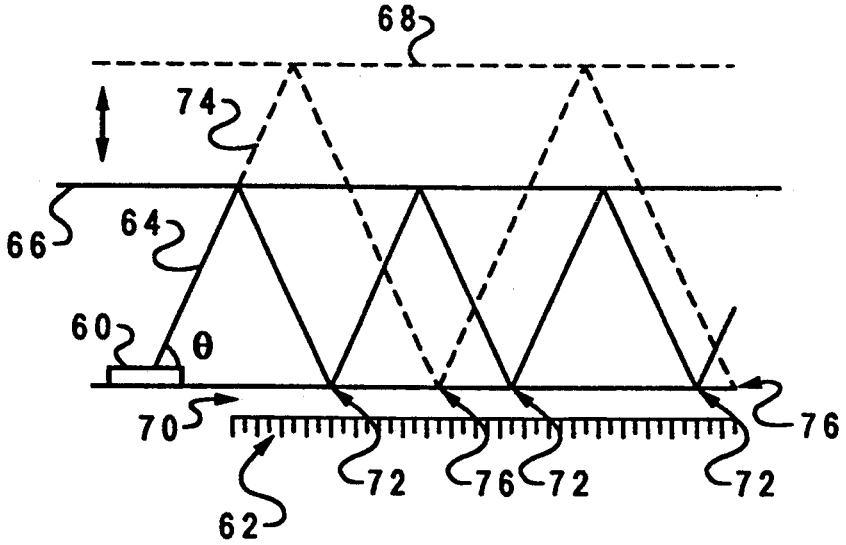
FIGS. 4 and 5 illustrate alternative preferred techniques for determining the physical position of a loudspeaker.

Referring to FIG. 4, a solid state laser 60 is preferably incorporated into a single chip with a CCD or other optical sensor 62. CCD 62 has a plurality of locations, often referred to a pixels, which indicate the presence or absence of light impacting them. Preferably, the frequency of the laser 60 is selected so as to maximize sensitivity of the CCD array.

A light beam 64 is projected from the laser 60 at an angle $\theta$ to strike a reflective surface 66. The reflective surface 66 moves vertically with respect with the plane of the CCD 62, so that one position is indicated by reference numeral 66, with a further position indicated by reference numeral 68. A reflective surface 70 is fixed with relation to the laser 60 and the CCD 62. Light beam 64 reflects between the surfaces 66 and 70 as shown in FIG. 4. Reflective surface 70 is partially transmissive, so that light energy is collected by the CCD and a digital 1 is registered at each location 72 which is struck by the beam 64.

When the reflective surface has moved to position 68, the light emitted by laser 60 follows the path of dotted line 74. Points 76 indicate those locations at which the beam 74 reflects from the fixed reflective surface 70, which are the points which generate a digital 1 within the CCD array 62. As shown in FIG. 4, when the reflective surface is in position 68, the spacing between reflection points 76 is greater than those between reflection points 72.

This information can be used in several ways by the DSP 38 in order to determine the precise position of the reflective surface 66 with relation to the fixed surface 70 and CCD array 62. In one technique, the number of digital is generated by the CCD array 62 can simply be counted. If the angle $\theta$ is selected so that a large number of reflections occur between the fixed surface 70 and the moving surface 66, such a simple count can indicate the position of the speaker with fairly high accuracy. If more precise accuracy is required, the DSP 38 can actually determine the locations of the reflection points 72, 76. One preferred technique is to use the pattern of 1s and 0s in the CCD array as an address into a look-up table, with the entries in the table directly providing the corresponding speaker position. This can be done in hardware within the sensor, which provides a digital position signal to the DSP 38. Alternatively, the raw CCD data can be sent to the DSP 38, which can perform the table lookup in memory. In many cases, the mechanical tolerances of the system will be loose enough that a simple count of the number of reflections which occurs will provide sufficient accuracy for the speaker position.

Figure 5:
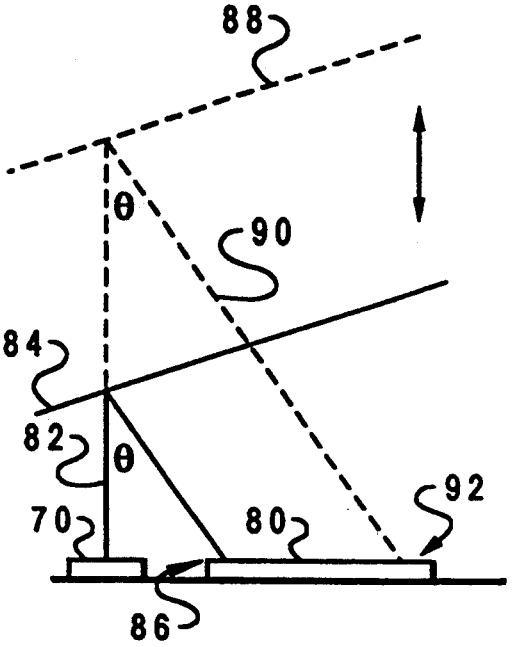

A related technique for determining speaker position is illustrated in FIG. 5. In this embodiment, a laser 78 and CCD array 80 are fixed in a common plane. Laser 78 projects a light beam indicated by line 82, which reflects off the reflective surface 84 connected to a movable part of the speaker. The reflective surface 84 is angled with respect to the plane of the laser 78 and CCD 80, so that the light reflects at an angle $\phi$ to impact the CCD 80 at point 86. The reflective surface is not required over the CCD 80 because only the single point 86 needs to be determined. As the reflective surface moves to position 88, the light beam follows the path indicated by dash line 90. The angle of reflection, $\phi$, from the surface at position 88 is the same as in position 84, with the result that the light beam follows the path 90 and impacts the CCD array 80 at point 92. As the reflective surface moves back and forth, the point on the CCD array 80 which registers the position of the light beam moves back and forth. The point at which the laser beam hits the CCD array 80 is directly proportional to the position of the reflective surface 84.

As is known in the art, CCD arrays can be treated as digital devices, and directly read out in a digital manner. This provides the digital position signal for communication to the DSP 38 over signal line 30 without provision of a digital/analog converter. This direct digital reading of speaker position simplifies the feedback loop compared to using a position sensor which performs an analog/digital conversion, although a system using such a conversion technique would be suitable for use with the present invention.

Figure 6:
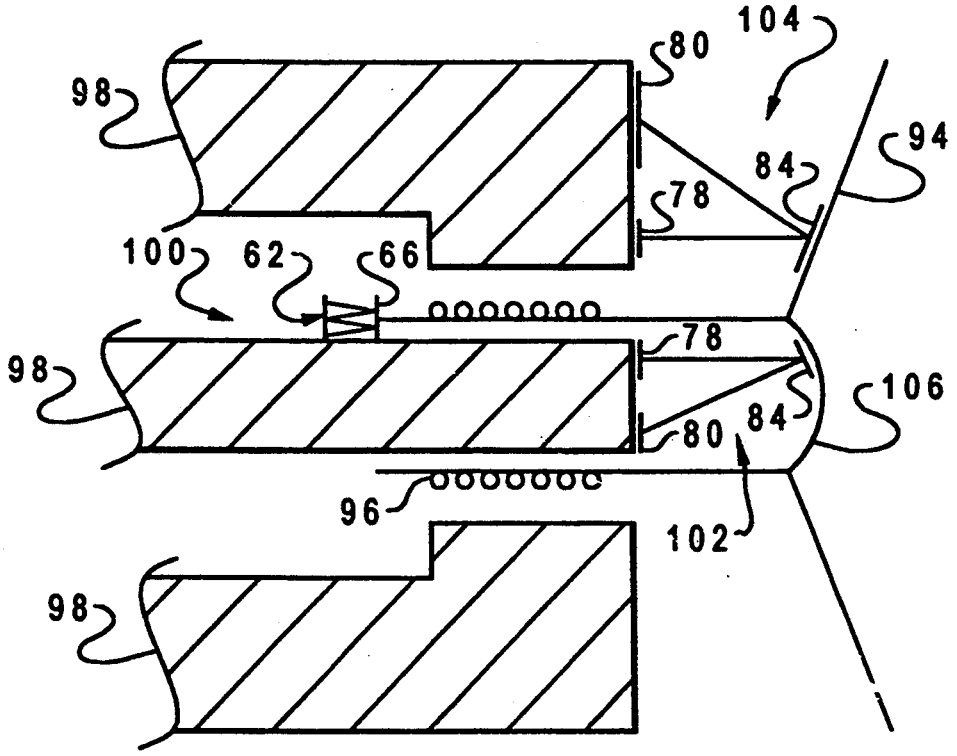
FIG. 6 illustrates several alternative locations for position detectors for use in conjunction with a conventional cone loudspeaker.

Referring to FIG. 6, several techniques for employing the sensors illustrated in FIGS. 4 and 5 are shown. A speaker cone 94 is driven by a voice coil 96. Magnetic fields of the coil work against the magnetic fields provided by a speaker magnet 98 to impart motion to the cone 94. A sensor of the type shown in FIG. 4 can be placed in position 100, with reflective surface 66 being attached to the moving portion of the speaker and CCD array 62 being affixed to the magnet 98 or other supporting structures.

Two of many possible positions for employing the technique illustrated in FIG. 5 are indicated by reference numbers 102 and 104. The reflective surface 84 can be attached to either the spyder 106, or to the speaker cone 94 itself. Preferably, the reflective surface is attached to a movable portion of the speaker which is subject to a minimum amount of flexure in order to maintain an accurate correspondence between the actual speaker position and the position read by the sensor.

Figure 7:
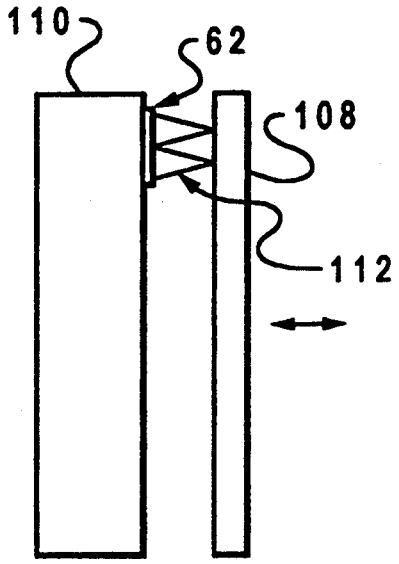
FIG. 7 illustrates the use of a position sensing device in connection with a flat speaker.

FIG. 7 is a simplified diagram of a flat speaker, in which the CCD array 62 is attached to the fixed part 110 of the speaker. A light beam 112 is reflected off of the moving part 108 as described with reference to FIG. 4. Since the moving portion of the speaker is parallel to the fixed portion, use of the embodiment of FIG. 4 is especially convenient.

If desired, more than one sensor can be used with a single speaker. The several position signals are used by the DSP 38 to compensate for mechanical difficulties such as speaker cone flexure. In the case of a flat speaker as shown in FIG. 7, multiple driving coils can be placed into an array and driven separately. Each driving coil has one or more associated position sensors. The DSP 38 can evaluate the various sensors separately, and drive the various driving coils, if more than one is provided, to generate the most accurate reproduction of the original audio signal.

It will be appreciated by those skilled in the art that the system described above may be implemented in many different ways. For example, although a preferred sensor has been described, other position sensors can be used. As long as the speaker position is made available to the controller, the technique of the present invention can be used.

It may be desirable to provide a capability for adjusting the volume of the audio program generated by the speaker independently of the audio signal provided on signal line 18. This may be done in several ways. For example, the incoming audio signal on line 18 can be scaled by multiplying it by a selected value. This value can be selected by a user at the individual speakers using any appropriate input means, such as an input potentiometer generating a voltage signal which can be converted to digital form and input to the controller. This allows balancing of the speakers independently of the signal conditioning subsystem 36, which can still be used. A related technique applies the scaling factor to the position signal input from signal line 30.

If the bandwidth of the signal line 18 is high enough, various control signals can be inserted into the audio data stream using any of many well known techniques. Typically, a special block header is used to indicate the presence of a control data block. These control signals can be used to instruct the controller to perform any number of desired activities, such as changing the volume scaling number, or delaying the output signal by some selected value or modifying calculations of the error signal, or delaying generation of the error signal relative to the audio position signal.

Since the DSP 38 provides a great deal of signal processing capability, in many systems it will be desirable to provide a full range of signal processing features which are available to the user by directly controlling the DSP 38. A remote control unit, such as those now widely available for controlling audio and video devices, communicates with a remote control input (not shown) connected to the DSP 38. Via this control mechanism, the user can modify the audio signal reproduced by the speaker. For example, special effects such as volume, delay, echo, phase, and frequency band equalization can be manipulated through the DSP 38 using techniques well known in the art. This allows each speaker in a particular environment to be individually "tuned" to maximize overall listening quality.

For example, in a large auditorium, several speakers reproducing the same audio signal may be positioned at widely spaced locations. Destructive and constructive interference between the sound reproduced by these speakers can cause "dead" spots and "live" spots within the listening area. Adjusting the phases of the speakers relative to each other can help minimize this effect. Since the DSP within each speaker can be used to easily control the phase of the signal reproduced by that speaker, it is a simple matter to utilize the techniques of the present invention to overcome this and other problems caused by the listening environment.

The signal processing capabilities just described can be used to simplify the embodiment described in FIG. 2. The signal conditioning system 36 can be dispensed with, and the DSP 38 used for all signal conditioning. For example, frequency band equalization can be performed in the DSP 38. As described above, other desired special effects can also be performed in the DSP 38, so that speakers designed in accordance with the above described techniques can be used with a digital audio source, such as a compact disk player, to provide a complete audio system.

Although the preferred embodiment uses all digital signals, with the exception of the error signal amplified to drive the speaker, it will be apparent to those skilled in the art that an analog audio signal could also be used to generate the error signal. This would involve the generation of an analog signal proportional to the actual speaker position. This signal is then compared with an analog audio signal to generate an error signal used to drive the error amplifier. The digital technique is preferred because it eliminates the distortion caused by analog components.

While the invention has been particularly shown and described with reference to a preferred embodiment, it will be understood by those skilled in the art that various changes in form and detail may be made therein without departing from the spirit and scope of the invention.

What is claimed is:

1. A system for reproducing audio signals, comprising:

an audio signal source which generates a digital audio signal;

a speaker having a fixed part and a movable part;

a sensor for detecting the position of the moveable speaker part relative to the fixed speaker part, and for generating a digital position signal corresponding to the position of the speaker moveable part, the sensor including:

an emitter for generating a beam of electromagnetic radiation, a reflector attached to the speaker moveable part for reflecting the beam of electromagnetic radiation, a sensing array for detecting the reflected beam of electromagnetic radiation and generating a digital signal indicating the position of the reflected beam on the array, and a partially reflecting surface covering said sensing array, wherein said reflector is positioned so that the beam is reflected at least twice between said reflector and said partially reflecting surface to form a pattern of detected beam locations on said sensing array, wherein said reflector is positioned so that movement of the speaker moveable part changes the pattern of the beam detected by said sensing array; and a controller connected to said sensor and to said signal source for driving the speaker moveable part to a position defined by the digital audio signal, the controller including:

a digital signal processor programmed to compare the digital audio signal and the position of the speaker moveable part, and to generate an error signal for driving the speaker moveable part to a position corresponding to the audio signal, a digital/analog converter to convert the error signal to an analog signal, and an analog amplifier connected to said digital-/analog converter and to the speaker moveable part for generating an analog signal to drive the speaker moveable part according to the error signal.

2. The system of claim 1, wherein said sensing array comprises a charge coupled device.

3. The system of claim 1, wherein said emitter comprises a solid state laser.

4. An audio reproduction system, comprising:

an audio signal input;

a speaker having fixed and movable parts;

a position sensor for detecting the position of the speaker movable part relative to the speaker fixed part, and for generating a digital signal proportional to such position;

an amplifier connected to the speaker movable part for driving the speaker movable part; and a digital processor controller connected to said amplifier, to said audio signal input, and to said position sensor, wherein said controller receives digital audio position signals from the audio signal input and stores a plurality of consecutive audio position signals including a current position and at least two later positions, calculates a difference between the actual position of the speaker movable part and a desired position defined by the stored audio position signals, generates an error signal which is a function of such difference and the stored audio position signals, and communicates the error signal to said amplifier to move the speaker movable part to the desired position;

wherein the digital processor controller looks ahead over said at least two stored later audio position signals to calculate said error signal which is generated to compensate for speaker mechanical inertia.

5. The system of claim 4, wherein said digital processor controller comprises a digital signal processor.

6. The audio reproduction system of claim 4, wherein the digital processor controller uses linear predictive coding to predict the future position of the speaker movable part.

7. The audio reproduction system of claim 4, wherein the error signal is generated to begin moving the speaker movable part ahead of time to compensate for mechanical characteristics of the speaker.

8. An audio reproduction system, comprising:

an audio signal input;

a speaker having fixed and moveable parts;

a position sensor for detecting the position of the speaker moveable part relative to the speaker fixed part, and for generating a digital signal proportional to such position;

an amplifier connected to the speaker moveable part for driving the speaker moveable part; and a digital processor controller connected to said amplifier, to said audio signal input, and to said position sensor, wherein said controller receives a digital audio position signal from the audio signal input, calculates a difference between the actual position of the speaker moveable part and a desired position defined by the audio position signal, generates an error signal, and communicates it to said amplifier to move the speaker moveable part to the desired position, wherein said controller is programmed to accept control signals from the audio signal input, and to modify calculations of the error signal in response to commands contained within the control signals.

9. The system of claim 8, wherein, in response to a volume control signal, said controller scales the actual position signal prior to calculating a difference with the audio position signal.

10. The system of claim 8, wherein, in response to a control signal, said controller delays generation of the error signal relative to the audio position signal.

11. The system of claim 8, wherein, in response to a control signal, said controller performs frequency band equalization on the audio position signal.

12. A method for driving an audio speaker, comprising the steps of:

receiving a digital audio signal value over an audio signal input line;

receiving control signals over the audio signal input line;

sensing a present position of an audio speaker, and generating a digital position value;

calculating a digital error signal proportional to at least a difference between the audio signal value and the digital position, wherein the error signal is modified in response to commands contained within the control signals;

converting the digital error signal to an analog signal; and driving the audio speaker in response to the analog signal to minimize the modified error signal.

13. The method of claim 12, wherein said steps of sensing, calculating, converting, and driving are performed at least twice for each audio signal value received.

14. The method of claim 12, further comprising the steps of:

retaining a selected number of audio signal values received in said receiving step; and in said calculating step, calculating a difference value proportional to the speaker position and to a value derived from the retained audio signal values.

15. The method of claim 14, further comprising, in said calculating step, including data regarding physical response characteristics of the speaker when calculating the difference value.

* * * * *